US007272897B2

(12) United States Patent
Yu

(10) Patent No.: US 7,272,897 B2
(45) Date of Patent: Sep. 25, 2007

(54) SANDAL HAVING A VARIETY OF LACING STYLES

(76) Inventor: Zu Sheng Yu, 31 Bayview Dr., Huntington, NY (US) 11743

( * ) Notice: Subject to any disclaimer, the term of this patent is extended or adjusted under 35 U.S.C. 154(b) by 0 days.

(21) Appl. No.: 10/402,713

(22) Filed: Mar. 28, 2003

(65) Prior Publication Data

US 2005/0257399 A1 Nov. 24, 2005

(51) Int. Cl.
*A43B 3/12* (2006.01)

(52) U.S. Cl. ..... 36/11.5; 36/100; 36/15

(58) Field of Classification Search ..... 36/137, 36/11.5, 7.5, 100, 101, 15, 23, 24, 30 R, 31; 362/103

See application file for complete search history.

(56) References Cited

U.S. PATENT DOCUMENTS

| | | | | | |
|---|---|---|---|---|---|
| 1,888,862 | A * | 11/1932 | Mathews | 36/12 |
| D94,638 | S * | 2/1935 | Stritter | 36/11.5 |
| 2,367,092 | A * | 1/1945 | Blotner | 36/11.5 |
| 2,526,940 | A * | 10/1950 | Fello | 36/11.5 |
| 2,551,723 | A * | 5/1951 | Camero | 36/11.5 |
| 2,680,309 | A * | 6/1954 | Peterson | 36/11.5 |
| 2,862,311 | A * | 12/1958 | Ellis | 36/11.5 |
| 3,019,534 | A * | 2/1962 | Kauffman et al. | 36/15 |
| 3,455,037 | A * | 7/1969 | Vlas et al. | 36/11.5 |
| 3,599,353 | A * | 8/1971 | Magidson | 36/11.5 |
| 3,800,444 | A * | 4/1974 | Young | 36/11.5 |
| 3,902,259 | A * | 9/1975 | Cracco | 36/11.5 |
| 3,982,336 | A * | 9/1976 | Herro | 36/62 |
| 4,297,798 | A * | 11/1981 | Colan | 36/101 |
| 4,530,171 | A * | 7/1985 | Zabala | 36/11.5 |
| 4,606,139 | A * | 8/1986 | Silver | 36/100 |
| 4,896,439 | A * | 1/1990 | Morgan | 36/7.5 |
| 4,935,851 | A * | 6/1990 | Wood | 363/103 |
| 4,936,028 | A * | 6/1990 | Posacki | 36/15 |
| 5,052,131 | A * | 10/1991 | Rondini | 36/137 |
| 5,423,134 | A * | 6/1995 | Bagnaia et al. | 36/11.5 |
| 5,430,621 | A * | 7/1995 | Raskas | 362/103 |
| 5,454,382 | A * | 10/1995 | Tariah et al. | 128/882 |
| 5,746,500 | A * | 5/1998 | Chien | 36/137 |
| 5,794,360 | A * | 8/1998 | Bell et al. | 36/7.6 |
| 6,128,834 | A * | 10/2000 | Vecchiola et al. | 36/11.5 |
| 6,516,538 | B2 * | 2/2003 | Kraft | 36/11.5 |
| 6,637,130 | B2 * | 10/2003 | Urie et al. | 36/11.5 |
| 2002/0116840 | A1 * | 8/2002 | Kraft | 36/11.5 |

FOREIGN PATENT DOCUMENTS

| | | |
|---|---|---|
| DE | 92072879 | 7/1992 |
| EP | 0342170 | 11/1989 |
| GB | 479921 | 2/1938 |
| GB | 2147792 | 5/1985 |

* cited by examiner

*Primary Examiner*—Marie Patterson
(74) *Attorney, Agent, or Firm*—F. Chau & Associates, LLC

(57) ABSTRACT

A sandal comprising a sole having a plurality of lace holes, grooves, and rings used for arranging at least one lace in a variety of styles when securing the sandal to the foot of the wearer. In other embodiments, the lace can be illuminated and the sole can have multiple layers.

13 Claims, 4 Drawing Sheets

SANDAL HAVING A VARIETY OF LACING STYLES

BACKGROUND

1. Technical Field

The present invention relates generally to footwear, and more specifically, to shoes having a plurality of lace holes, grooves, and rings used for arranging at least one lace in a variety of styles.

2. Description of Related Art

In the past most sandals have attached to the foot of the wearer by using straps fixed to the sole of the sandal to encase the foot of the wearer. The straps were generally one piece and fixed to the sole of the sandal at two or more points creating an area between the sole of the sandal and the strap that the wearer's foot could slide under, thereby securing the sandal to the foot of the wearer. Some sandal straps consist of more than one piece with one end of the strap attached to the sole of the sandal and the other end of the strap brought over the top of the foot so that the strap can be either buckled or snapped together with a corresponding end of another strap originating from the opposite side of the sandal.

Unlike sandals that use straps to secure the sandal to the foot, the present invention pertains to sandals using laces that can be strung, arranged, and tied in various patterns. Integration of multiple arrangements of the laces into the overall sandal design enhances marketability of the sandal and creates an aesthetically pleasing appearance.

Additionally, in accordance with an embodiment of the present invention, the laces can be illuminated. Numerous lighting arrangements for footwear have been previously proposed or are currently marketed to enhance safety by increasing the visibility of the wearer while at the same time adding to the attractiveness of the footwear. Illumination of the laces is convenient because assembly of the illumination arrangement to the sandal is simplified, while allowing integration of the illumination arrangement into the overall sandal design to further enhance marketability and avoid a retrofitted appearance.

SUMMARY OF THE INVENTION

The present invention allows various decorative arrangements of at least one lace when using laces to secure a sandal to a wearer's foot. In accordance with an embodiment of the present invention, a sandal comprises a sole having a plurality of lace holes, grooves, and rings wherein the lace holes, grooves, and rings are positioned along the perimeter of the sole of the sandal. A further embodiment according to the present invention comprises lace holes, grooves, and rings positioned at a plurality of angles through or partially through the sole of the sandal.

Having a plurality of lace holes, grooves, and rings allows different lacing techniques to be used when lacing a sandal. For example, the laces can extend from one side of the sole of the sandal across the top of the foot to the opposite side of the sole of the sandal, the laces can further extend through the sole of the sandal, then the laces can further wrap around a wearer's foot, ankle, calf, leg, or any combination of foot, ankle, calf, and leg, in a decorative manner before continuing back to the sole of the sandal on the other side of the foot. The present invention allows for any combination of lace holes, grooves, and rings to be used to string at least one of a plurality of laces when using laces to secure the sandal to the wearer's foot. According to another embodiment of the present invention, the lace can be illuminated further enhancing the aesthetic appeal of the sandal. In addition, more than one lace can be used to secure the sandal to the wearer's foot.

According to another embodiment of the present invention, a sandal comprises a multi-layer detachable sole thereby allowing replacement of a worn out sole, without having to discard the entire sandal.

These, and other aspects, features and advantages of the present invention will be described or become apparent from the following detailed description of the preferred embodiments, which is to be read in connection with the accompanying drawings.

DETAILED DESCRIPTION OF PREFERRED EMBODIMENTS

Figure 1:
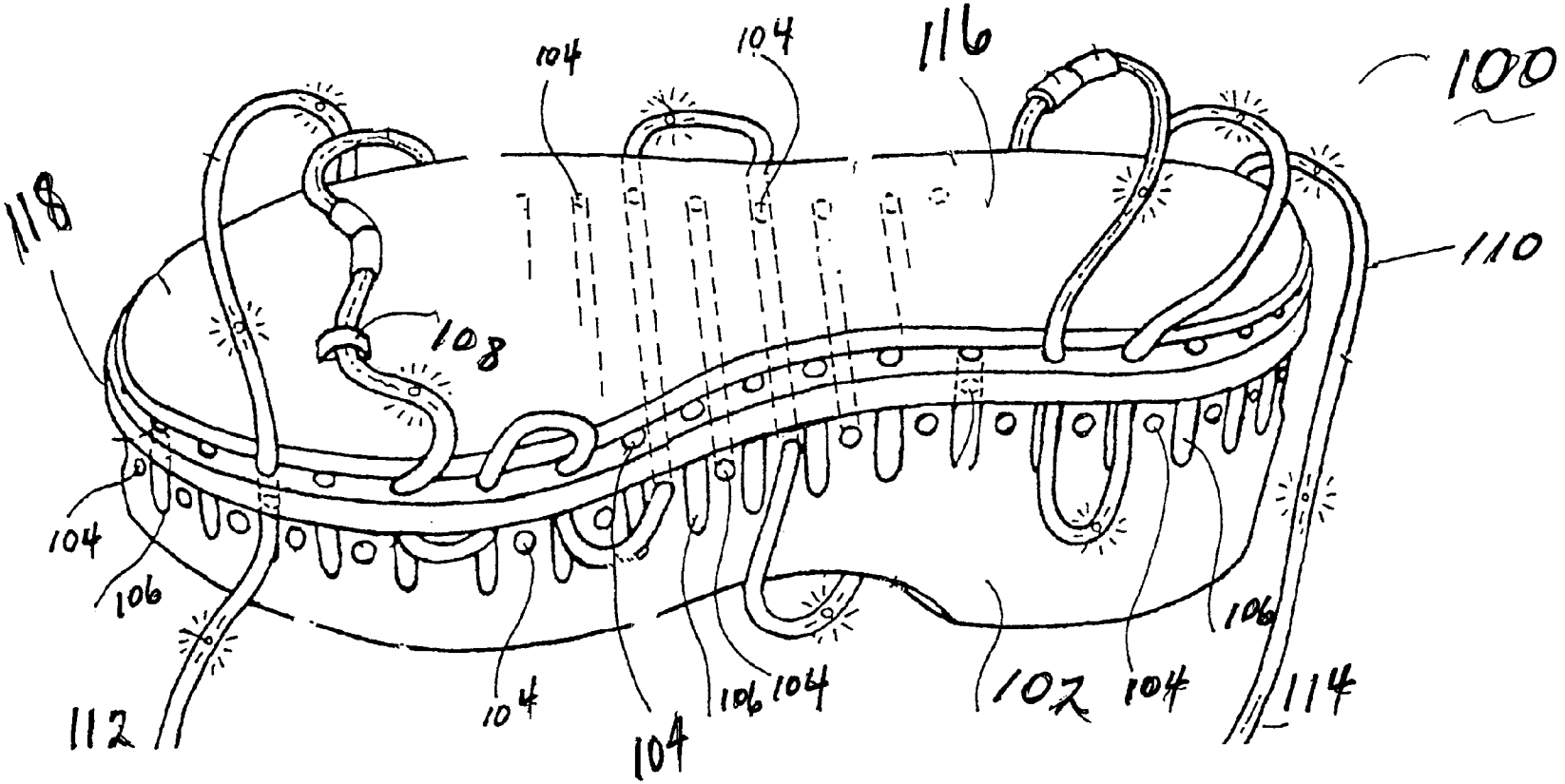
FIG. 1 is an exemplary illustration of a sandal according to an embodiment of the present invention.

With reference now to the Figures, the illustration of FIG. 1 depicts an example of a sandal 100 according to an embodiment of the present invention. In general, sandal 100 comprises a sole 102 having a plurality of redirection holes 104, grooves 106, and rings 108 for stringing a lace 110. The lace 110 is preferably a transparent plastic tube having a first end 112 and a second end 114, but can comprise any flexible material. The sole 102 can further include a top layer 116 and a bottom layer 118. The plurality of redirection holes 104 can further be provided between the top layer 116 and the bottom layer 118. The top layer 116 and the bottom layer 118 can be connected together. In still another embodiment according to the present invention, the plurality of redirection holes 104, grooves 106, and rings 108 can string more than one lace (not shown).

Figure 2:
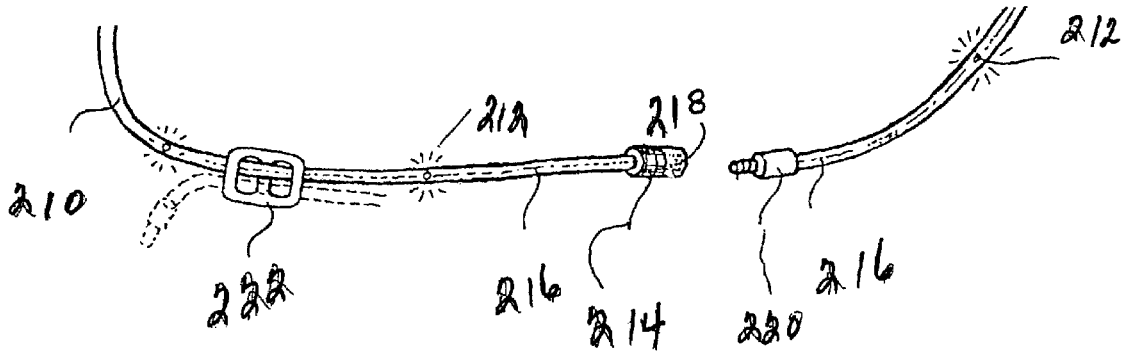
FIG. 2 is an exemplary illustration of a lace according to an embodiment of the present invention.

Referring to FIG. 2, in a preferred embodiment a lace 210 includes lights 212 within its interior surface that can flash or remain constantly illuminated, for decorative purposes. The lace 210 also includes a power supply 214, for example, a battery, that provides electric current to the lights using an electrically conductive material 216 within the interior surface of the lace that is connected to the lights 212 and power supply 214 to form an electric circuit. The power-supply 214 can be positioned behind an electrically conductive female connector 218 affixed to the first end of the lace 210 that can be coupled to an electrically conductive male connector 220 affixed to the second end of the lace 210, thereby completing the electric circuit. The lace 210 can further have a plurality of connectors and power supplies (not shown). In another embodiment according to the present invention, the lace includes an adjusting mechanism 222 that adjusts the length of the lace for a comfortable fit of the sandal on the wearer's foot.

Figure 3A:
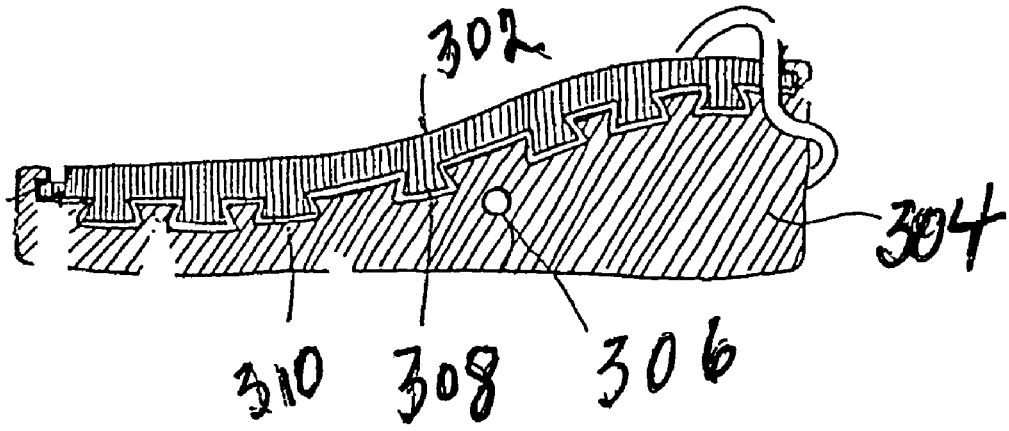
FIG. 3A is an exemplary illustration of a side view of layers of a sole of a sandal according to an embodiment of the present invention.
Figure 3B:
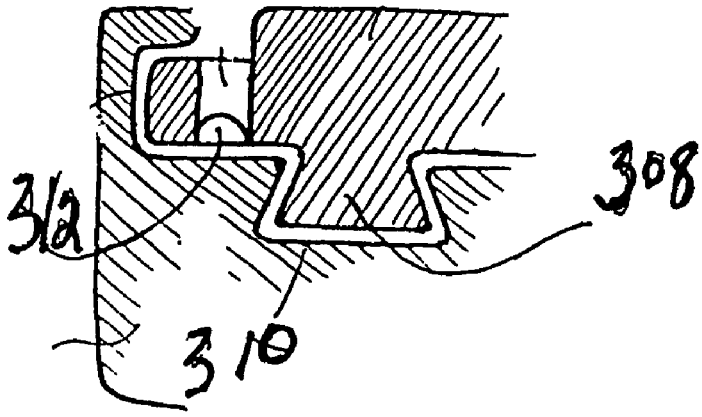
FIG. 3B is an exemplary illustration of a channel incorporated into a sole locking mechanism according to an embodiment of the present invention.

Referring to FIG. 3A, in a preferred embodiment according to the present invention, the sole comprises a plurality of layers. A first layer 302 that is in contact with a wearer's foot and a second layer 304 that is in contact with a surface. The first layer 302 having at least one of a plurality of redirection rings for stringing at least one of a plurality of laces and the second layer 304 having at plurality of redirection holes and grooves for stringing at least one of a plurality of laces, as illustrated in FIG. 1. Again referencing FIG. 3A, the first layer 302 and the second layer 304 are affixed to each other using a locking mechanism. The locking mechanism is preferably comprised of a plurality of tongues 308 arranged on the first layer 302 and a plurality of grooves 310 arranged on the second layer, wherein the plurality of tongues 308 and the plurality of grooves 310 are arranged oppositely to each other such that the plurality of tongues 308 interlock with the plurality of grooves 310 when pressed together. As shown in FIG. 3B, the locking mechanism can further include a channel 312 for stringing a lace thereby hiding the lace from view and obtaining a seamless connection between the first layer 302 and second layer 304. Additionally, any number of layers of soles can be affixed together to obtain a more comfortable fit of the sandal on a wearer's foot.

Figure 4:
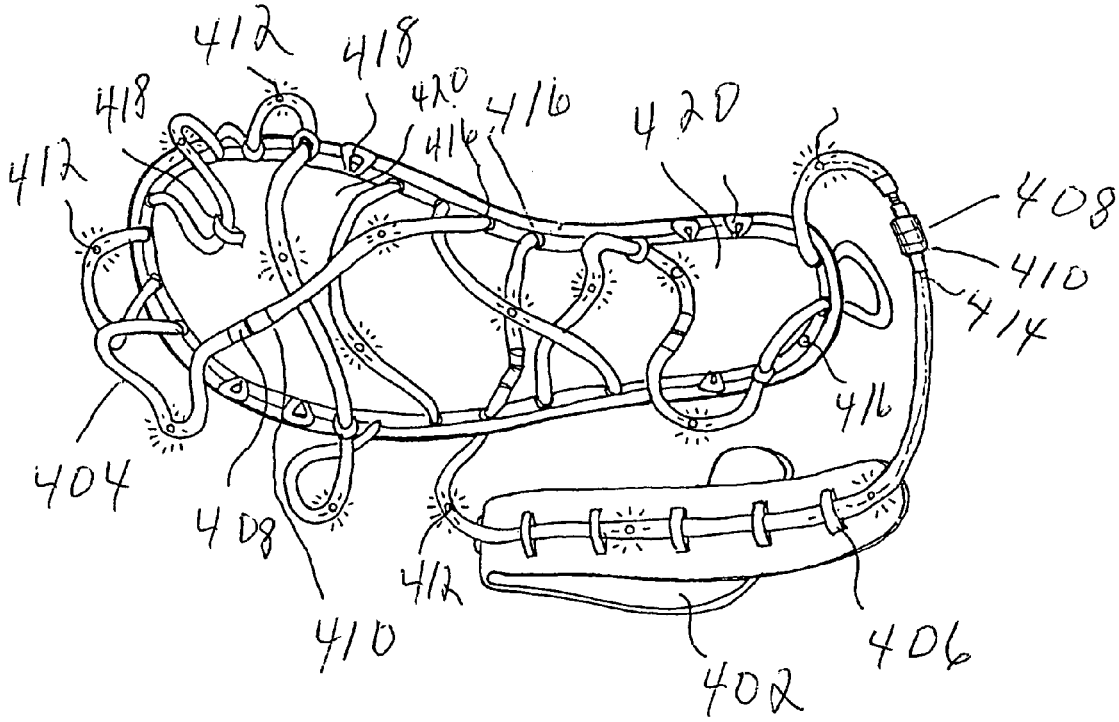
FIG. 4 is an exemplary illustration of a top view of a sandal according to an embodiment of the present invention.

Referring to FIG. 4, a top view of a sandal is illustrated according to an embodiment of the present invention. The lace 404 can include a moveable anti-friction pad 402 positioned over the lace 404 to prevent irritation of a wearer's skin arising from friction of the lace 404 against the skin. The anti-friction pad 402 further includes a plurality of securing devices 406 used to movably affix the anti-friction pad 402 to the lace 404.

Further illustrated are a plurality of electrically conductive connectors 408 (both male and female shown in a connected position) and a plurality of power supplies 410. The electrically conductive connectors 408, the power supplies 410, and a plurality of illumination devices 412 provided within the interior surface of the lace 404, are connected using a electrically conductive material 414 also provided within the interior surface of the lace 404. The lace 404 is strung through a plurality of redirection holes 416, grooves (not shown), and rings 418 that are provided on the perimeter, on a top surface, and within an interior surface (not shown) of a sole 420, thereby forming a receptacle to secure the sole 420 to a wearer's foot. The receptacle formed serves as a top portion of a shoe.

When securing the sandal to a foot, any combination of redirection holes 416, grooves, and rings 418 can be used for stringing the lace 404. Additionally, in conjunction with using any combination of redirection holes 416, grooves, and rings 418, to secure the sandal to the foot, the lace can be wrapped around any portion of the wearer's toes, foot, ankle, calf, and leg in a plurality of decorative styles. Obtaining a plurality of decorative styles from a single pair of sandals advantageously increases the marketability of the sandal.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the present invention.

What is claimed is:

1. An article of footwear comprising:

a first layer shaped to match the bottom of a wearer's foot, the first layer having side-to-side widths larger than corresponding widths of the foot;

a lacing portion attached to the first layer to form an edge of the first layer, the lacing portion having a plurality of bores disposed spaced apart and substantially equal distance from each other around the entire lacing portion including the frontmost portion, the side portions and the backmost heel portion of the first layer;

a second layer attached to the first layer; and at least one lace which extends through at least two bores to connect to itself or to another lace to thereby secure the first layer to the wearer's foot, wherein the lacing portion and the bores are positioned to be accessible to facilitate reconfiguration of the footwear by restringing the at least one lace through the same bores previously strung or through different bores without removal of the first layer.

2. The article of footwear of claim 1, wherein the at least one lace is made of a flexible material.

3. The article of footwear of claim 1, wherein the first and second layers are affixed to one another using a locking mechanism.

4. The article of footwear of claim 3, wherein the locking mechanism includes a plurality of tongues arranged on the first layer and a plurality of grooves arranged on the second layer wherein the at least one of the plurality of grooves on the second layer receives the at least one of the plurality of tongues on the first layer, thereby locking the first and second layers together.

5. The article of footwear of claim 4, wherein the locking mechanism includes a channel for receiving the at least one lace.

6. The article of footwear of claim 1, further comprising an anti-friction device movably affixed to the at least one lace.

7. The article of claim 1, wherein the second layer has the same size and shape as the first layer.

8. The article of claim 1, wherein the bores are oriented vertically with respect to the surface of the first layer contacting the foot.

9. An article of footwear comprising:

a first layer shaped to match the bottom of a user's foot, having side-to-side widths larger than corresponding widths of the foot:

a lacing portion attached to and extended from the side-to-side widths of the first layer, the lacing portion having a plurality of bores; and a second layer disposed under the first layer and configured to contact a walking surface, wherein the lacing portion is formed in between the first and second layers and the plurality of bores are accessible to facilitate reconfiguration of the footwear by restringing at least one lace through the plurality of bores without removal of the first layer, wherein the first and second layers are affixed to one another using a locking mechanism, wherein the locking mechanism includes a plurality of tongues arranged on the first layer and plurality of grooves arranged on the second layer wherein the at least one of the plurality of grooves on the second layer receives the at least one of the plurality of tongues on the first layer, thereby locking the first layer and the second layer together.

wherein the locking mechanism includes a channel for receiving the at least one lace.

10. The article of footwear of claim 9, wherein the at least one lace is made of a flexible material.

11. The article of footwear of claim 9, further comprising an anti-friction device movably affixed to the at least one lace.

12. The article of claim 9, wherein the second layer has the same size and shape as the first layer.

13. The article of claim 9, wherein the bores are oriented vertically with respect to the surface of the first layer contacting the foot.

* * * * *